US006637974B1

(12) United States Patent
Glenn

(10) Patent No.: US 6,637,974 B1
(45) Date of Patent: Oct. 28, 2003

(54) ROLLER WALL GUARD FOR FLOOR FINISHING MACHINES

(75) Inventor: J. Brandall Glenn, Boise, ID (US)

(73) Assignee: Multiquip, Inc., Carson, CA (US)

( * ) Notice: Subject to any disclaimer, the term of this patent is extended or adjusted under 35 U.S.C. 154(b) by 0 days.

(21) Appl. No.: 10/171,928

(22) Filed: Jun. 13, 2002

(51) Int. Cl.[7] ..... E01C 19/22
(52) U.S. Cl. ..... 404/112
(58) Field of Search ..... 404/112, 96, 97

(56) References Cited

U.S. PATENT DOCUMENTS

| | | | | | |
|---|---|---|---|---|---|
| 3,973,857 | A | | 8/1976 | Whiteman, Jr. | 404/112 |
| 4,027,991 | A | | 6/1977 | Maass | 404/112 |
| 4,046,483 | A | * | 9/1977 | Sutherland | 404/112 |
| 4,198,178 | A | | 4/1980 | Carlstrom et al. | 404/112 |
| 4,320,986 | A | | 3/1982 | Morrison | 404/112 |
| 4,752,154 | A | | 6/1988 | Valentine | 404/72 |
| 5,221,156 | A | | 6/1993 | Martin | 404/97 |
| 5,238,323 | A | * | 8/1993 | Allen et al. | 404/85 |
| 5,480,257 | A | | 1/1996 | Allen | 404/112 |
| 5,480,258 | A | * | 1/1996 | Allen | 404/112 |
| 5,533,830 | A | | 7/1996 | Barichello | 404/96 |
| 5,658,089 | A | | 8/1997 | Allen | 404/112 |
| D416,564 | S | | 11/1999 | Allen et al. | D15/28 |
| 6,019,545 | A | | 2/2000 | Allen et al. | 404/112 |
| D466,909 | S | | 12/2002 | Allen et al. | D15/10 |

* cited by examiner

*Primary Examiner*—Thomas B. Will
*Assistant Examiner*—Alexandra K. Pechhold
(74) *Attorney, Agent, or Firm*—Frank J. Dykas; Robert L. Shaver; Stephen M. Nipper

(57) ABSTRACT

A roller wall guard system for use on a surface-finishing machine having a circular guard ring of a given circumference made up of a pair of wall guards. Each wall guard has an arc shaped arm having a first end attached to a roller and extending along a length to a second end also having a roller. Each arm is pivotally connected to the surface-finishing machine at an intermediate location between the first and second ends, so that the arm pivots within a controlled arc. The length of the arms and the diameters of the rollers are configured to define a line between a point of rolling engagement of the first roller against a second surface and a point of rolling engagement of the second roller against the second surface. The line lies outside of the circumference of the guard ring. When a first roller contacts a second surface, the arm pivots about the attachment so that the second roller contacts the second surface and the surface-finishing machine is directed in a line of travel parallel to the second surface.

10 Claims, 4 Drawing Sheets

ROLLER WALL GUARD FOR FLOOR FINISHING MACHINES

BACKGROUND OF THE INVENTION

1. Field of the Invention

The present invention generally relates to an attachment for surface-finishing machines, and more particularly relates to a roller wall guard attachment for powered rotary concrete finishing machines.

2. Background Information

Surface-finishing machines are used in a variety of applications to finish a variety of surfaces. These machines include floor sanders, buffers and concrete finishing machines. While the specific configuration of each machine is different, generally these machines are made up of a rotor which supports the structure and assists in moving the device. The rotor may have a variety of attachments including pads, discs, finishing trowels, float pans or other devices attached to it. In the context of a concrete finishing machine, the attachments usually include devices such as rotary trowel attachment blades, float pans or other devices.

The rotor of a concrete finishing machine is usually driven by a motor mounted above the rotor upon a frame. The motor and the machine, in general, are usually controlled by a handle which extends from the frame to a gripping portion where a user can grasp the handle and control the movements of the machine. In most cases, the rotary attachment portion is covered by a protective set of guardrails or a covering. The protective guardrail or covering prevent objects and persons from contacting the circulating parts of the device. These protective coverings are usually circular to protect the entire area where the rotor spins.

This covering portion, while protecting the user from the rotating portion, makes contacting floor surfaces proximate to or adjoining an object having a vertical component, such as a wall, difficult. When finishing machines come into contact with these objects, the protective guardrail or covering prevents the finishing portion of the device from obtaining access to the portions of the surface proximate to the walls or other objects. As a result, the surface portions near these areas are not contacted by the finishing machine and are not appropriately finished. In order for these portions to be finished, they must be finished by another device or done by hand. An example of a typical concrete finishing machine can be seen in U.S. Pat. No. 4,673,311 issued to Marvin Whiteman on Jun. 16, 1987. The teachings of said patent are incorporated herein by reference.

After a concrete surface has begun to set, but before the concrete has hardened (a state referred to as being "green"), a concrete trowel is used to put a desired finish upon the surface of the concrete. This finish is achieved as the finishing trowels of the concrete finishing machine contact and grind against the concrete surface. The rotating action of the concrete finishing trowels against the concrete surface also acts to propel the finishing machine in a desired direction. This movement can be controlled by the operator lifting up or pushing down upon the handle of the device. By lifting or lowering the handle of the device, the operator can cause the concrete finishing machine to move to the left and to the right while simultaneously moving in a generally forward or backward direction over a concrete surface.

While the concrete finishing machine is moving, the machine may come into contact whit a second surface, such as a wall, post or other object. When the protective cover of the concrete-finishing machine impacts against the wall or object, the finishing machine can damage the wall or object. Sometimes the finishing machine will bounce off of the wall or object and then return to impact the wall again. This process may repeat itself over and over and result in damage to the secondary surface - the surface being finished as well as the surface-finishing machine itself.

Damage can also occur while attempting to hold a surface-finishing machine against a secondary surface such as a wall or object. In this instance, the protective cover vibrating against the wall or object causes damage to the secondary surface. In addition, this impedance of the surface-finishing machine can cause the surface being finished to be scarred and improperly finished.

The impact of the concrete finishing machine against the wall or object can also cause the rotor to rock back and forth and to be moved out of alignment. Both the rocking of the rotor and the spinning motion of the rotor while out of alignment can cause the rotor to become destabilized, and cause wear and damage to the rotor, the motor and other moving parts of the surface finishing machine.

Therefore, what is needed is a surface-finishing device with a wall contact portion that allows the surface-finishing device to finish surfaces proximate to those walls and objets. What is further needed is a surface-finishing device with an attachment that allows the device to finish surfaces proximate to secondary surfaces such as walls and other objects without causing damage to those secondary surfaces. What is further needed is a device that allows a surface-finishing device to finish a surface proximate to a secondary surface such as a wall or object without causing damage to the finishing machine or the surface being finished. What is further needed is a protective device that fulfills these needs that is also retrofittable for attachment to existing surface finishing machines.

Accordingly, it is an object of the present invention to provide a surface-finishing device with a wall contact portion that allows the surface-finishing device to finish surfaces proximate to walls and objects. Another object of the present invention is to provide a device that allows for surface finishing near secondary surfaces such as walls and objects without incurring damage to these secondary surfaces. Another object of the present invention is to provide a device that allows a surface-finishing device to finish a surface proximate to a wall or object without incurring damage to the finishing machine. Another object of the invention is to provide an attachment that accomplishes these objects and is adapted for retrofittable connection with existing surface finishing machines.

Additional objects, advantages, and novel features of the present invention will be set forth in part in the description as follows, and in part will become apparent to those skilled in the art upon examination of the following, or may be learned by practice of the invention. The objects and advantages of the invention may be realized and obtained by means of the instrumentalities and combinations particularly pointed out in the appended claims.

SUMMARY OF THE INVENTION

The present invention is a roller wall guard system for use on a concrete power trowel having a generally circular protective cover made up of a pair of guard assemblies. Each assembly is made up of a generally arc shaped arm having a first end extending to a second end along a desired length. A pivotable connection point, located at an intermediate point along the arm between the first end and the second end, provides a pivotable connection between the guard assembly and the protective cover of the surface-finishing machine. Both the first and second ends of the arm are configured to rotatably hold a roller. Each roller has a diameter and is rotatably connected to the ends of the arm in an orientation so as to allow for rolling engagement of the roller with the secondary surface. The length of the arm and the diameter of the rollers are configured to form a line between a point of rolling engagement of the first roller against the secondary surface and a point of rolling engagement of the second roller against the secondary surface. This line lies outside the circumference of the protective cover.

In use, when contact is made between a first roller and the secondary surface, the arm pivots so that the second roller also contacts the secondary surface. These rollers then direct the surface-finishing machine in a generally smooth line of travel along the secondary surface. Damage to the surface finishing machine, the surface being finished, and the secondary surface is reduced or limited because the rollers of the wall guard prevent the protective cover of the concrete finishing machine from contacting the wall. Furthermore, the force of the contact made by the rollers is directed along the path of travel of the concrete finishing machine.

The wall guards are connected to the protective cover in a way that allows them to be added and removed as desired. This feature also allows the wall guards to be retrofittedly adapted for placement upon existing surface-finishing machines.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
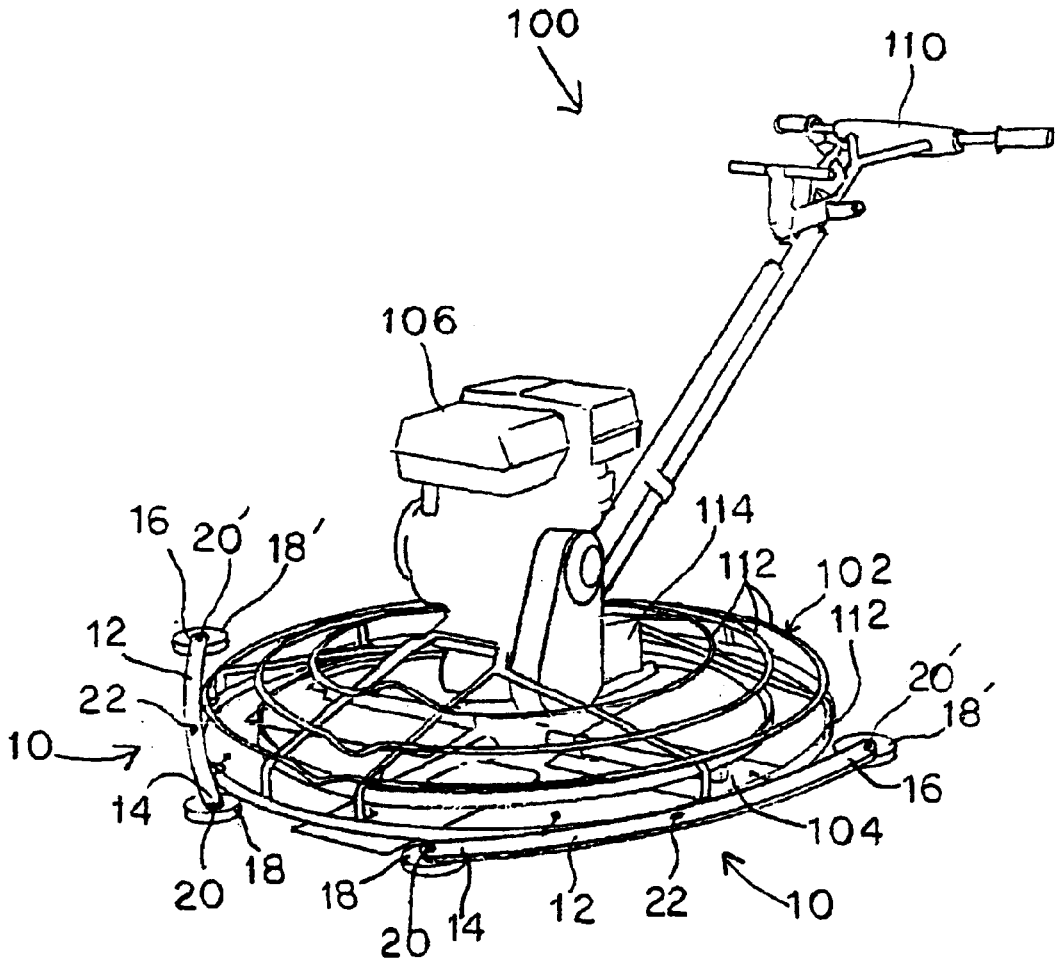
FIG. 1 is a perspective view of a first embodiment of the present invention in use on a concrete finishing machine.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a wall guard system for use on a surface-finishing machine having a protective cover enclosing a rotating portion of the device. The invention allows a surface-finishing machine to finish a generally horizontal surface near a secondary surface, such as a wall or other object, without damage to that secondary surface and without damaging the finishing machine itself. The invention provides at least two rollers connected to a surface-finishing machine in a manner whereby when a first roller contacts the secondary surface, the other roller also is preferably brought into contact with the secondary surface. A line between the contact portion of the first roller and the contact portion of the second roller lies outside the dimensions of the protective cover of the surface-finishing device.

The present invention is described in the context of being attached to a concrete power towel used for finishing concrete. However, it is to be understood that the invention may be used on any surface-finishing machine that is used upon a surface. This includes but is not limited to floor buffers, polishers, sanders, grinders, smoothers, finishers or any other similar devices. Therefore, the following description should be viewed as illustrative in nature and not as restrictive.

Referring now to FIG. 1, a first embodiment of the present invention is shown. The invention 10 is attached to a concrete surface-finishing machine 100 having a protective cover 102. In this embodiment, the protective cover 102 is a cage made up of a series of generally circular guardrail 112. The surface-finishing machine 100 has a rotating portion 104, is case an array of radially oriented troweling blades, that travels in a generally circular path within the protective cover 102. This protective cover 102 usually covers the rotating portion 104 along its path of travel. In most instances where the rotating portion 104 is a single rotating trowel attachment, the protective cover has a generally circular shape. A motor 106 is mounted to a frame 114 and connected to the rotating portion 104 by a rotor. control of the motor 106 and a variety of other functions of the device are usually accomplished through a series of controls that are connected to a handle 110 which is also used to direct and guide the surface-finishing device 100 as it travels over a finishing area.

For example, the direction of travel of the surface-finishing device can be controlled by pushing the handle 110 up or down. By pushing up or down on the handle 110, the surface-finishing machine 100 can be made to move forward, backward, to the left, or to the right. Oftentimes, a party using such a device will finish an area by moving the surface-finishing machine 100 back and forth (to the left and to the right) while moving forward and/or backward across a surface. While this technique is useful in finishing open spaces, it causes a variety of problems when used in an area proximate to a secondary surface such as a wall or object. In this situation, the usual back and forth motion of the surface-finishing machine can cause damage to the wall as the protective covering 102 of the surface-finishing machine 100 impacts against the secondary surface.

To prevent this damage, in the present invention a pair of roller guard assemblies 10 are attached to the protective cage 102 of the concrete finishing machine 100. Each guard assembly 10 is comprised of an arm 12 having a first end 14 and a second end 16. The length, shape, and design of the arm 12 may be modified to incorporate a variety of designs and may be used in a variety of applications. While in this embodiment, the arm is shown as being generally arcuate or arc shaped, it is to be distinctly understood that any shape which accomplishes the purposes of the invention may be used. In some embodiments, the length and dimensions of the arm 12 may be adjustable to provide for a variety of distances and lengths between the two ends 14, 16. In some embodiments, the arms may made up of a combination of pieces or segments.

Now referring to FIGS. 1 through 4, each end 14, 16 of the arm 12 is rotatably connected to a roller 18, 18' by an attachment assembly 20, 20'. The rollers can be of various shapes, designs, colors, and materials, depending upon the application in which they are used. The attachment assembly 20, 20' can also be made of various materials depending upon the requirements of the activity in which the device is being used. For example, in one embodiment, the rollers are urethane wheel assemblies having a desired diameter. In other embodiments, the size, shape, material, and dimensions of the device may be varied to accommodate the specific necessities of the user.

These rollers 18, 18' are rotatably connected to the arm 12 through a roller attachment means 20. These roller attachment assemblies may be any one or a combination of a variety of means for attaching a roller to the arm. These means include but are not limited to bolts, rivets, couplers, posts or any other means that allow relatively free rotation of a roller. The freedom of rotation of the rollers 18, 18' is increased by the inclusion of bearings either as a part of the rollers 18, 18' or as a part of the attachment means 20, 20'. The inclusions of bearings may or may not be required or necessary depending upon the particular use in which the device is involved.

The arm 12 is pivotally attached to the protective cover 102 of a finishing machine by an attachment connection 22. A variety of pivotable attachment connection devices 22 may be utilized to achieve this result. The arm attachment connection 22 may connect directly to the protective cover 102 through a pivoting device such as a carriage bolt assembly, pivot boss and pin, various combinations of rods, bushings or any other forms for pivotal attachment. In other embodiments, the attachment connection for attaching the arm 12 to the surface-finishing machine 100 may include a device having its own separate structure.

The combination of the arm 12 and the rollers 18, 18' are preferably designed and dimensioned so that when a first roller (either 18 or 18') contacts a second surface, the other roller (either 18 or 18') is also brought into contact with the second surface. A line, outside the dimensions of the protective cover 102, is then formed between the point of contact of the first roller 18 and the point of contact of the second roller 18' Further movement of the surface-finishing device will proceed along a line defined by the points of contact of the two rollers 18, 18'. These rollers 18, 18' prevent the surface-finishing machine 100 from coming into contact with the wall or secondary surface and direct the surface-finishing device in a generally smooth path of travel parallel to the direction of the wall or secondary surface. These rollers prevent damage to the secondary surface, the surface being finished as well as the surface-finishing machine 100 itself.

Figure 2:
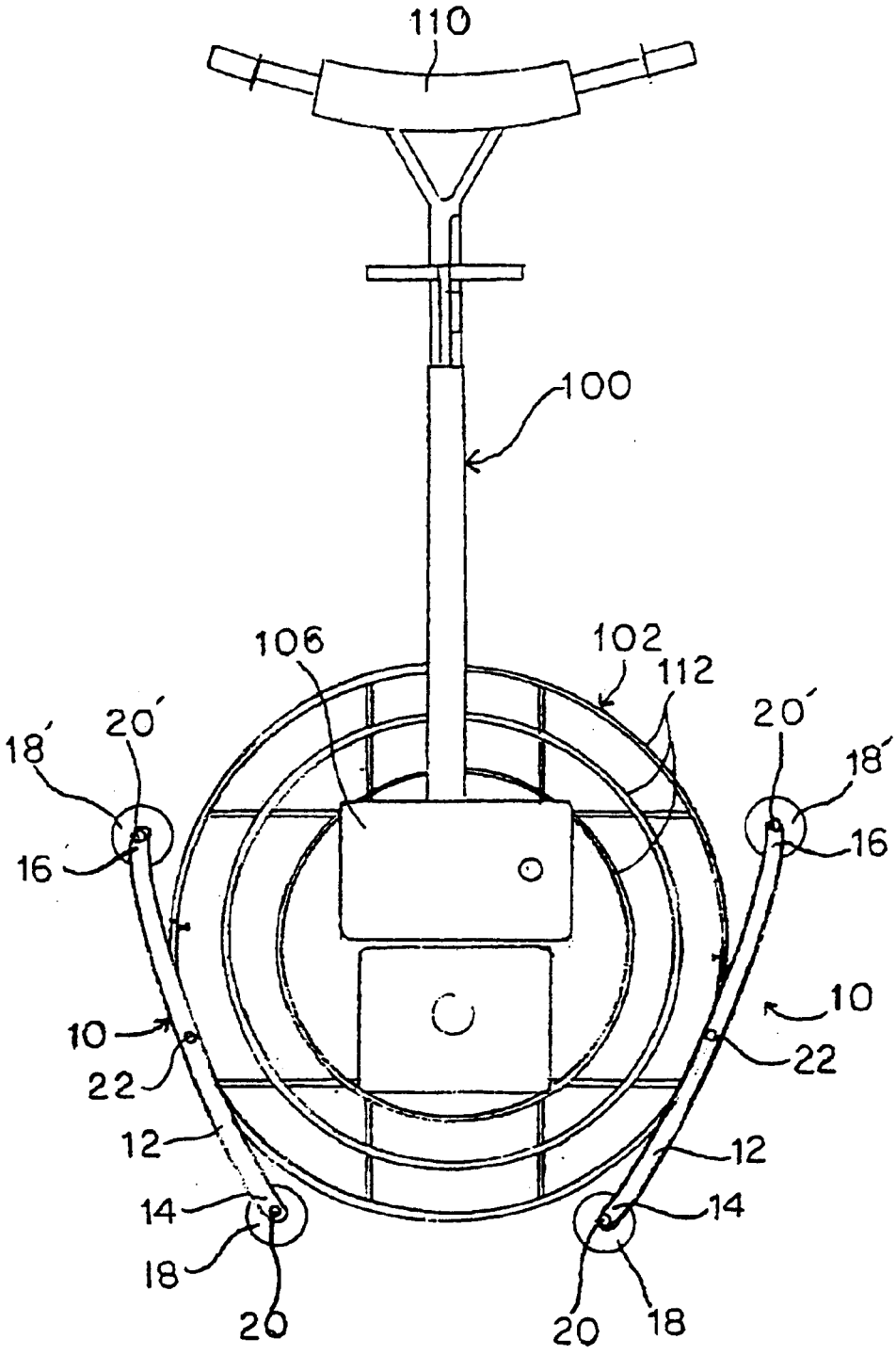
FIG. 2 is a top plan view of the same embodiment shown in FIG. 1.

Referring now to FIG. 2, a top plan view of one embodiment of the present invention is shown. This view shows one embodiment of the wall guard devices 10 in placement along a circular protective guard ring of the surface-finishing device. The arms 12 are generally horizontally pivotingly connected to the bottom most guardrail 112 of the circular protective guard ring 102. The type and location of the pivoting connection 22 may be varied dependent upon the exact requirements of the secondary surface and location of the area to be finished. As previously discussed, any variety of attachment devices 22 may be used to pivotally connect the arm 12 to the surface-finishing machine 100.

In a preferred embodiment, the attachment device 22 places the pivot point in a position along the protective cover 102 in a location about 135-degrees from the direction of the handle 110 of the surface-finishing machine. This location allows a pair of arms 12 having the length and the configuration of the arms shown in the preferred embodiment to contact wall surfaces and prevent most portions of the protective cover 102 of the surface-finishing machine from contacting a secondary surface.

Figure 3:
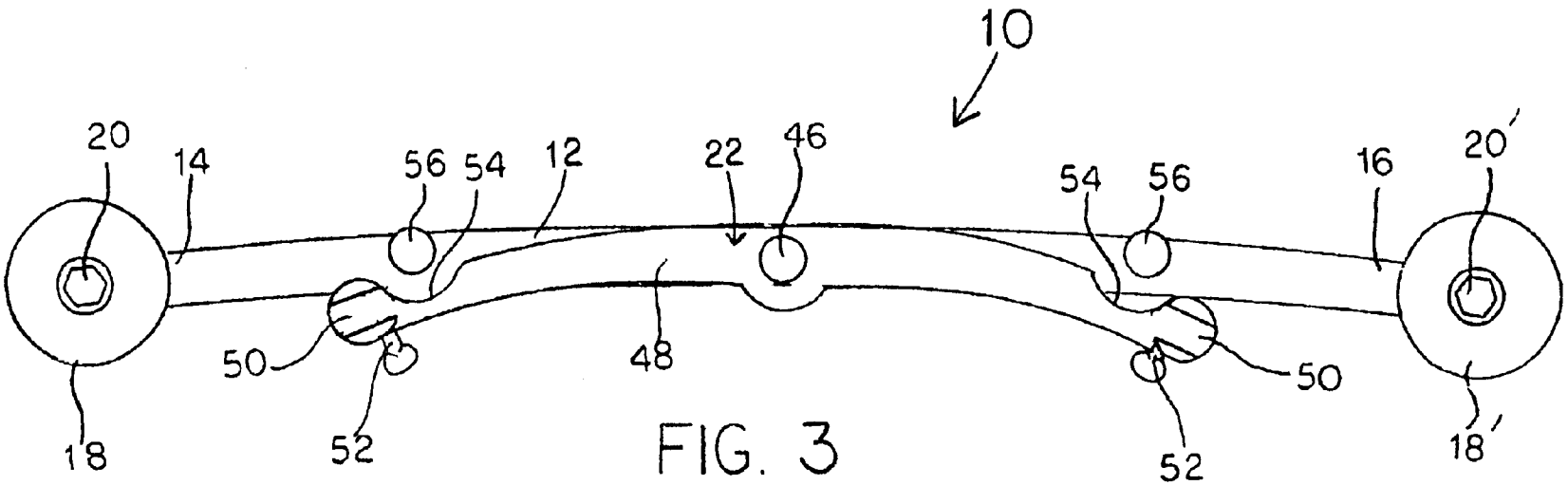
FIG. 3 is a detailed bottom view of a first embodiment of the guard assembly of the present invention.

FIG. 3 shows a bottom view of one embodiment of a wall guard 10. In this embodiment, the attachment device 22 is made up of a generally curved connection plate 48 adapted to conform to the ring shaped bottom guardrail 112 of a protective cover 102 of a concrete surface-finishing machine 100. Each end of the connecting plates 48 has a groove 50 adapted to hold a guardrail 112 from a protective covering 102 of a surface-finishing machine 100 therein. A connecting plate attachment device 52 holds and secures the connecting plate 48 to the guardrail 112. In this embodiment, this connecting plate attachment device 52 is a threaded bolt and a complimentarily threaded hole in one of the sides of the groove 50. This threaded bolt when tightened assists to hold the curved connection plate 48 on the bottom ring of the protective covering 102. In as much as these attachment devices 52 are selectively releasable and attachable, the guard assemblies 10 can be removed and replaced as desired. While in this embodiment, the manner of attaching the guard 10 to the protective cover 102 is shown. It is to be distinctly understood that the manner of attaching the connecting plate 48 may be by any means sufficient to connect and hold the pivoting arm 12 to the surface-finishing machine. This includes but is not limited to devices that allow for removable connection such as bolts, screws, clasps, and clamps as well as more permanent methods such as welding, soldering, or riveting the connecting plate to the surface-finishing machine.

The curved connection plate 48 is connected to an arm 12 by a pivoting connector 46 that allows the arm 12 to pivot. A variety of means and methods may be used to pivotally connect the connection plate 48 to the arm 12. These include but are not limited to carriage bolt assemblies, pivot boss and pin assemblies and various combinations of rods, bushings or other forms for pivotal attachment.

The curved connection plate 48 preferably has at least one pair of carved-out indentations 54 that are positioned to correspond with a pair of posts 56 attached to the arm 12. In a preferred embodiment, these posts 56 are connected to the underside of the arm 12. These curved out portions 54, in combination with the posts 56, limit the range of pivot or swing that the arm 12 may have. By limiting the amount of swing that the arms 12 have, a pair of arms 12 may have the ability to place two rollers 18 attached to different arms 12 against a secondary surface and protect that secondary surface from the surface-finishing machine 100.

In the preferred embodiment, the amount of rotational pivoting allowed by the posts 56 is preferably limited to ten to fifteen degrees about an axis to allow for fine travel adjustment. While posts 56 are used in this embodiment to restrict the movement of the arm, a variety of other devices may also be used to restrict the pivoting of the arms 12 and are also contemplated within this invention. Such devices include but are not limited to adjustable posts, gears, ratchets or other mechanisms that provide a means for limiting or restricting the amount of movement of the travel arm. This includes devices that are adjustable.

This wall guard device 10 allows the machine to obtain a close finish proximate to the wall or object without damaging the wall, object, or surface proximate to the wall or object. This device also prevents damage to the surface-finishing machine itself by preventing bouncing, or rubbing of the protective cover against the wall or object. In a preferred embodiment, these devices can be added or retrofitted to existing machines to provide these advantages to existing surface finishing machines.

Figure 4:
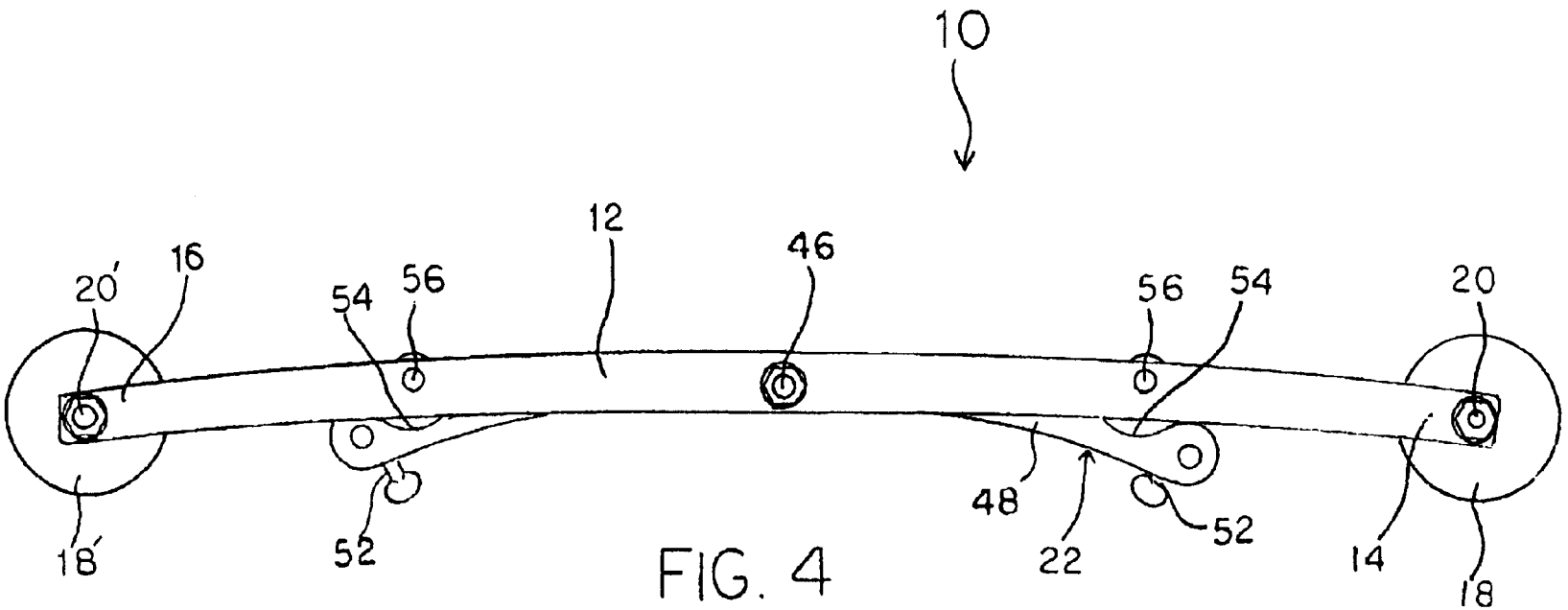
FIG. 4 is a detailed top view of the first embodiment of the guard assembly shown in FIG. 3.

FIG. 4 shows a detailed top view of the embodiment shown in FIG. 3. In use, the wall guard 10 is connected to the surface-finishing machine (not shown) by the attachment device 22. When one roller 18, 18' contacts a secondary surface such as a wall or other object, the arm 12 pivots about the pivoting attachment means 46 and the other roller 18, 18' is brought into contact with the secondary surface. A line between the contact portion of the first roller 18, 18' and the contact portion of the second roller 18, 18' lies outside the dimensions of the protective cover of the surface-finishing device. Thus, any further movement of the device against the wall is directed along the wall in a direction generally parallel to the orientation of the wall. This action prevents the surface-finishing machine from causing damage or injury to the secondary surface.

While there is shown and described the present preferred embodiment of the invention, it is to be distinctly understood that this invention is not limited thereto but may be variously embodied to practice within the scope of the claims. A variety of differing embodiments of the invention, including variations in size, shape, dimensions, and manners in which the protective covering of a surface-finishing machine, in conjunction with a pair of rollers contacting a secondary surface without the dimensions of the protective covering are contemplated by this invention and disclosure. From the foregoing description, it will be apparent that various changes may be made without departing from the spirit and scope of the invention as defined by the following claims.

I claim:

1. A roller wall guard configured for attachment to a surface finishing machine, said surface-finishing machine for finishing a generally horizontal surface which adjoins a second surface, said surface-finishing machine having a circular guard ring of a given circumference, wherein said roller wall guard comprises:

an arm having a first end extending along a length to a second end, said arm configured to pivotally attach to said surface-finishing machine at an intermediate point along said arm between said first and second ends through a pivotal attachment device, said first and second ends each being configured to rotatably hold a roller; and a pair of rollers, each roller having a diameter and rotatably attached to an end of said arm in an orientation adapted for rolling engagement against said second surface;

wherein the length of said arm and the diameter of said rollers are configured so as to define a line between a point of rolling engagement of said first roller against said second surface and a point of rolling engagement of said second roller against said second surface, said line lying outside of said circumference of said guard ring;

whereby when one of said rollers engages said second surface said arm will pivot about said pivotal attachment device and the other roller will also come into engagement with said second surface.

2. The roller wall guard of claim 1 wherein said rollers are removeably attached to said surface finishing machine.

3. The roller wall guard of claim 1 wherein said arm has a generally arcuate shape.

4. The roller wall guard of claim 1 wherein said roller guard is adapted for additional placement upon existing surface finishing machines.

5. The roller wall guard of claim 1 wherein said roller guard is attached to said circular guard ring.

6. The roller wall guard of claim 1 herein said pivotal attachment device is configured to permit said arm to pivot through a predefined arc.

7. The roller wall guard of claim 1 wherein said rollers self-align to define a line between a point of contact of a first roller and a point of contact of a second roller outside said guard ring when contact is made with said second surface.

8. The roller wall guard of claim 7 wherein said line lies parallel to a line tangent to said guard ring.

9. A roller wall guard system for use on a surface finishing machine, said surface-finishing machine for finishing a generally horizontal surface which adjoins a second surface, said surface-finishing machine having a generally circular guard ring of a given circumference, wherein said roller wall guard system comprises:

first and second wall guards each having an arcuate arm with a first end extending along a length to a second end and configured for pivotal attachment to said surface-finishing machine at an intermediate point along said arm between said first and second ends, said first and second ends each rotatably connected to a roller having a diameter and positioned in an orientation adapted for rolling engagement against said second surface, wherein the length of said arms and the diameter of said rollers are configured so as to define a line between a point of rolling engagement of one of said first rollers against said second surface and a point of rolling engagement of a corresponding second roller against said second surface, said line lying outside of, and on generally opposite sides of, said circumference of said guard ring and wherein when one of said rollers engages said second surface the arm will pivot about said pivotal attachment and the other roller will also come into engagement with said second surface.

10. The roller wall guard of claim 9 wherein said pivot is controlled through a predefined arc.

* * * * *